United States Patent [19]

Borella

[11] Patent Number: 5,001,885

[45] Date of Patent: Mar. 26, 1991

[54] APPARATUS AND METHOD FOR MAKING FLORAL DISPLAYS, MINI-GIFTS AND POUCH TYPE PACKAGING

[76] Inventor: Robert J. Borella, 17 Grunauer St., Saddlebrook, N.J. 07622

[21] Appl. No.: 239,194

[22] Filed: Aug. 31, 1988

[51] Int. Cl.[5] ..... B65B 11/58; B65B 67/08

[52] U.S. Cl. ..... 53/136.1; 53/449; 53/453; 53/464; 53/172; 53/575; 53/221; 53/390

[58] Field of Search ..... 53/414, 449, 453, 456, 53/464, 172, 390, 575, 592, 221, 135; 493/464, 956; 428/17, 24, 25, 26; 206/457, 458

[56] References Cited

U.S. PATENT DOCUMENTS

| | | | |
|---|---|---|---|
| 860,578 | 7/1907 | Shogran | 493/956 X |
| 943,796 | 12/1909 | Shoeran | 493/956 X |
| 1,497,276 | 6/1924 | Hirschhorn . | |
| 2,062,276 | 11/1936 | Burton | 428/26 X |
| 2,148,587 | 2/1939 | Slocum | 53/172 |
| 2,165,840 | 7/1939 | Doble | 53/464 X |
| 2,218,293 | 10/1940 | Muller . | |
| 2,282,657 | 5/1942 | Kirchen | 428/26 |
| 2,486,762 | 11/1949 | Pfeiffer | 53/453 |
| 2,506,021 | 5/1950 | Holmberg | 53/592 |
| 2,622,380 | 12/1952 | Snyder | 53/464 |
| 2,921,420 | 1/1960 | Kawamura | 53/464 X |
| 3,269,090 | 8/1966 | Schmied . | |
| 3,550,353 | 12/1979 | Haadsma . | |
| 4,442,765 | 4/1984 | Limehouse et al. . | |
| 4,525,983 | 7/1985 | Libow | 53/221 |
| 4,570,415 | 2/1986 | Centeno . | |

FOREIGN PATENT DOCUMENTS

| | | | |
|---|---|---|---|
| 30871 | 5/1907 | Austria | 428/26 |
| 446574 | 2/1948 | Canada | 53/575 |
| 265577 | 5/1988 | European Pat. Off. | 53/390 |

*Primary Examiner*—John Sipos

*Attorney, Agent, or Firm*—Lerner, David, Littenberg, Krumholz & Mentlik

[57] ABSTRACT

An apparatus and method for fabricating floral displays, and other products formed by layers of superposed materials such as pouch or pocket type packages has a base member with an opening therethrough in communication with a receiving space below the base member and at least one or more plate members with openings therein serially and pivotably connected to the base member so they can be pivoted from an open or disengaged position to a closed or engaged position superposed over the base member and/or another of the plate members to bring the openings therein into alignment with one another and with the opening in the base member to permit layers of material to be positioned on the base and between each of the given number of plates, and a plunger tube is used to depress and move the layers of material so they gather or pinch inwardly into the area about the opening to form a centrally disposed depressed section, pouch or pocket for selectively and electively receiving random items therein, spaced clips connected to the base on opposite sides of the opening are used to hold a closure member such as a ribbon for tying the layers of material about the centrally disposed section and to permit the fabricated floral display, pouch or pocket type package or other layered product to be removed from the receiving space below the base member.

The apparatus and method as above described wherein the base member is adapted for detachable connection with at least one of a plurality of adapter each respectively having openings of different diameter or a single adapter with a variable opening thereon, and operatively associated plate members with sized openings for operative association with a given adapter.

13 Claims, 13 Drawing Sheets

FIG. 15
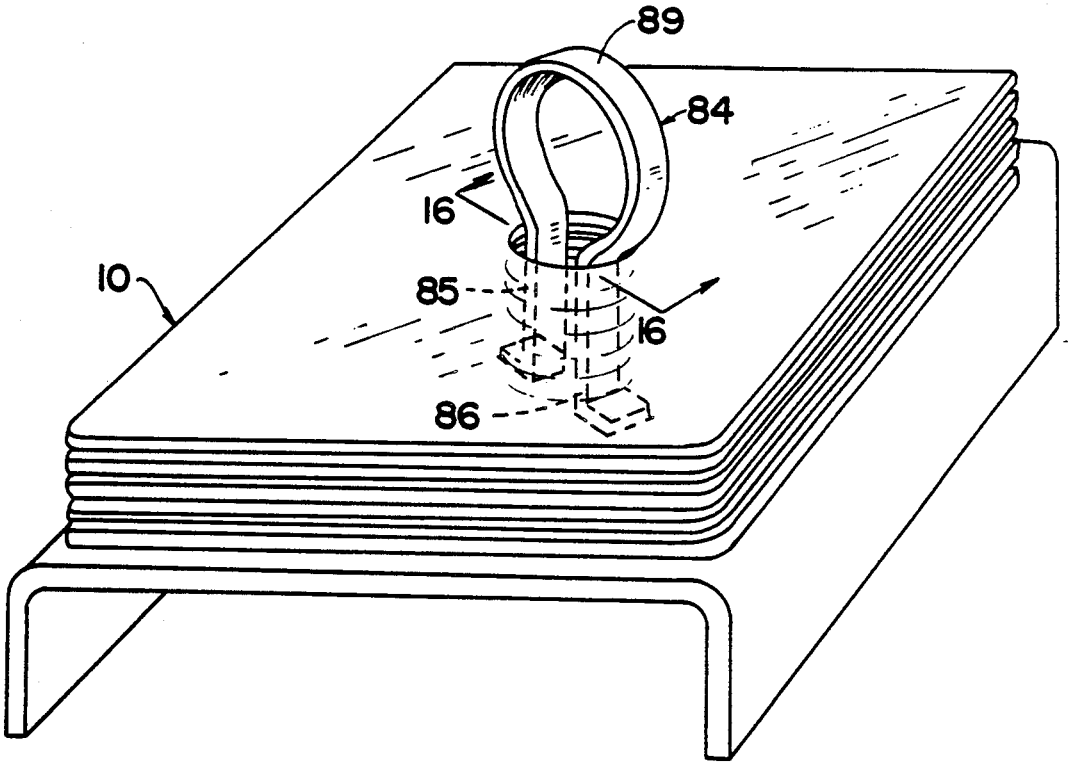
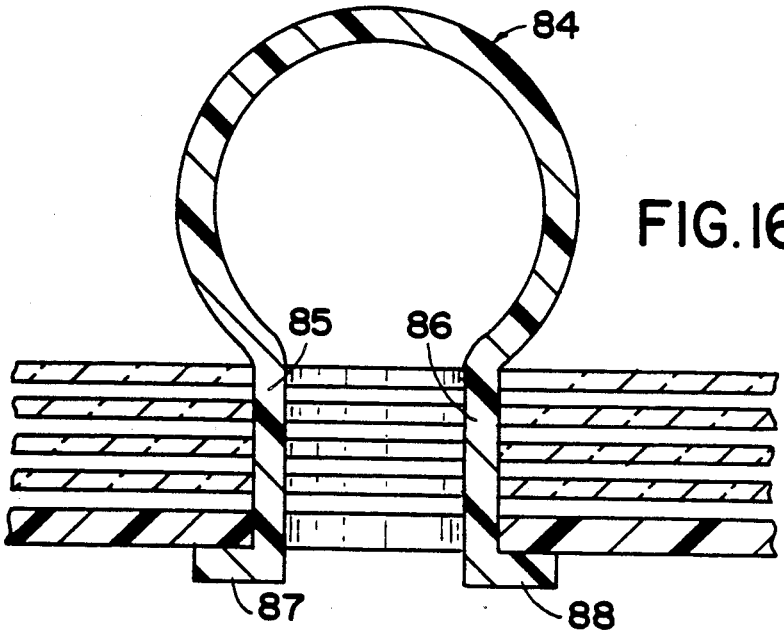
FIG. 16

FIG. 20
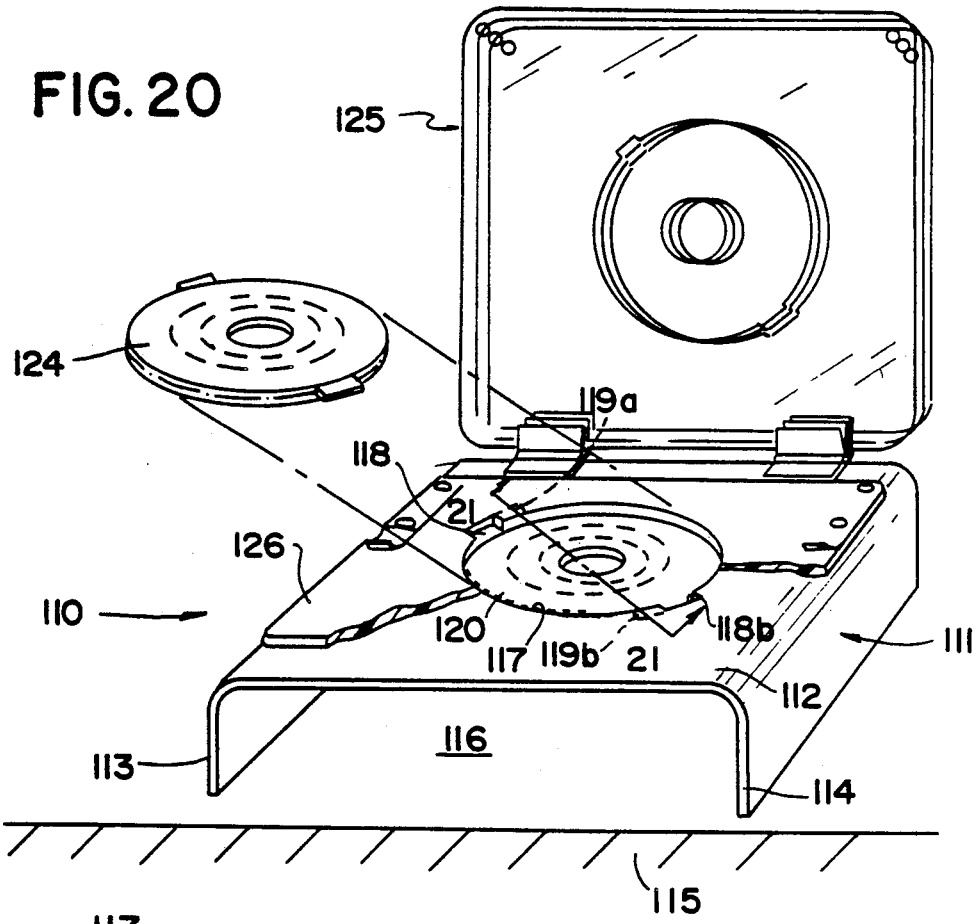
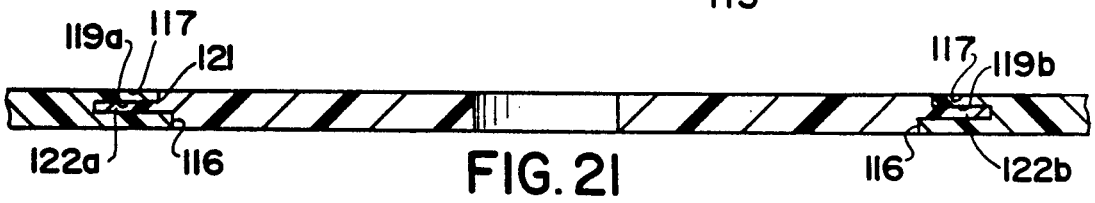
FIG. 21
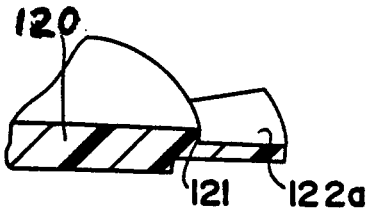
FIG. 22
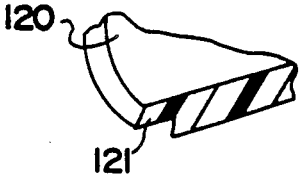
FIG. 20A
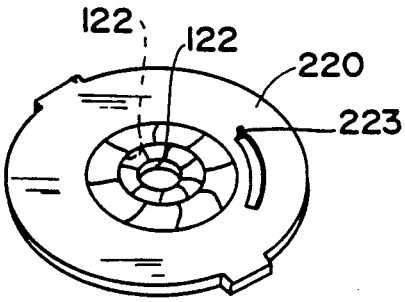
FIG. 20B

APPARATUS AND METHOD FOR MAKING FLORAL DISPLAYS, MINI-GIFTS AND POUCH TYPE PACKAGING

BACKGROUND OF THE INVENTION

This invention relates generally to packaging apparatus and methods for making floral displays and other products formed by layers of superposed materials such as pouch or pocket type packages, and more particularly to an apparatus and method for making pouch type packages, sachets, and the like devices for holding random items, adaptable to also fabricate decorative flower sprays, party favors and other accessory items.

There is a tremendous need for creating exciting inexpensive floral displays, premium devices, and other mini-gifts, and mini-packages all of which are neatly, specially, and festively designed or wrapped for special and memorable occasions such as Halloween, birthday, sweet sixteen, weddings, showers, housewarmings, office and store openings.

Handmade devices of this type are known, but it is often desirable to make their party favors quickly and in the limited quantities for the particular occasion.

One approach for meeting the need for this type of device can be found in the packaging industry which provides a vast and complex body of prior art devices, apparatus, and methods for forming a corresponding large number of varied types, sizes and forms of packaging.

Packaging of random items for a variety of purposes when the random items are contained in a relatively small pouch or pocket type packaging device does not lend itself readily to simple and inexpensive apparatus and methods because the formation of such packaging in limited quantities does not warrant the need for special equipment. Heretofore, as indicated above such packages were created by hand from suitable material which limits the quantities that can be created quicker.

Further, it is highly desirable to provide not only the types of devices and products, but suitable apparatus which can be used by the consumer to create marvelous state of the art decorative displays, devices and packaging, and the like with a minimal investment in product and space.

Additionally, a simple machine can be used by the retailer for creating not only a product line for such displays, devices, mini-gifts, and packaging products, but further a rental arrangement as well as a product offering of such machines.

Various efforts have been made in the prior art for achieving these desirable end results as is shown in U.S. Pat. Nos. 1,497,276, 2,921,420 3,269,090, 3,550,353, and 4,570,415.

SUMMARY AND OBJECTS OF THE INVENTION

Thus, the present invention covers an improved apparatus for forming displays, mini-gifts, other layered types of products and a package for the packaging of random items having a base means with a sized opening therein for communication with the free space below said base means, the base means having surface means thereon to receive at least one layer of material so disposed that the layer of material overlies the opening in the base means, and pusher means operatively insertable into the sized opening to form a sized depression in the said layer of material having an end opening for the receipt of random items if desired, and means for holding a closure member to be connected around the sized depression in the layer of material to form the desired display, mini-gift, package and the like and to enable the formed display or package to be removed from the opening in the base means.

Additionally, the apparatus as above described including, means operatively connectable to said base means to vary the sized opening therein, surface means adapted to coact with each of the various sized openings, and mating pusher means for each of the varying sized openings.

Accordingly, it is an object of the present invention to provide an apparatus and method for creating floral displays, mini-gifts, and pouch or pocket type packaging devices which are inexpensive to make and have a unique appearance.

It is another object of the present invention to provide an apparatus and method which can enable a retailer to create a marvelous state of the art party center with a minimal investment in product display space and store space.

It is another object of the present invention to provide an apparatus and method which is simple, efficient and relatively cheap, and adapted to produce in quantity floral displays, mini-gifts, and pouch or pocket type packaging having unique and exceptional appearance; are festively designed and wrapped, and which can be used for many special and memorable occasions.

It is another object of the present invention to provide an apparatus and method for making floral designs, mini-gifts and pouch or pocket type packaging of unique and exceptional appearance in which each of the units fabricated are a substantial duplicate of the other which duplicates can be made in quantities.

With these and other objects in view, the invention will be better understood by reference to the attached description taken with the drawings in which:

DESCRIPTION OF THE FIGURES

FIG. 15 is a diagrammatic sketch of the apparatus shown in FIGS. 1 to 9 of the drawings with the clamping and handle member in position for locking or preventing movement of the movable plates and for providing a handle for lifting and carrying the apparatus.

FIG. 16 is a fragmentary cross-section taken on line 16—16 of FIG. 15.

FIG. 20 shows a diagrammatic sketch of an alternate form of the apparatus shown in FIGS. 1 to 9 of the drawings showing an adapter for modifying the size of the opening in the base and plate members.

FIG. 20A is a fragmentary cross-section of the periphery of the adapter shown in FIG. 20 of the drawings.

FIG. 20B shows a diagrammatic sketch of an alternate form of adapter having an Iris type means for varying the size of the opening in the adapter used in the alternate form of the apparatus shown in FIG. 20 of the drawings.

FIG. 21 is a cross-section taken on line 21—21 of FIG. 20.

FIG. 22 is a fragmentary view of the locking means for holding the adapter in assembled position on the base as shown in FIG. 20.

DESCRIPTION OF ONE PREFERRED EMBODIMENT

Figure 1:
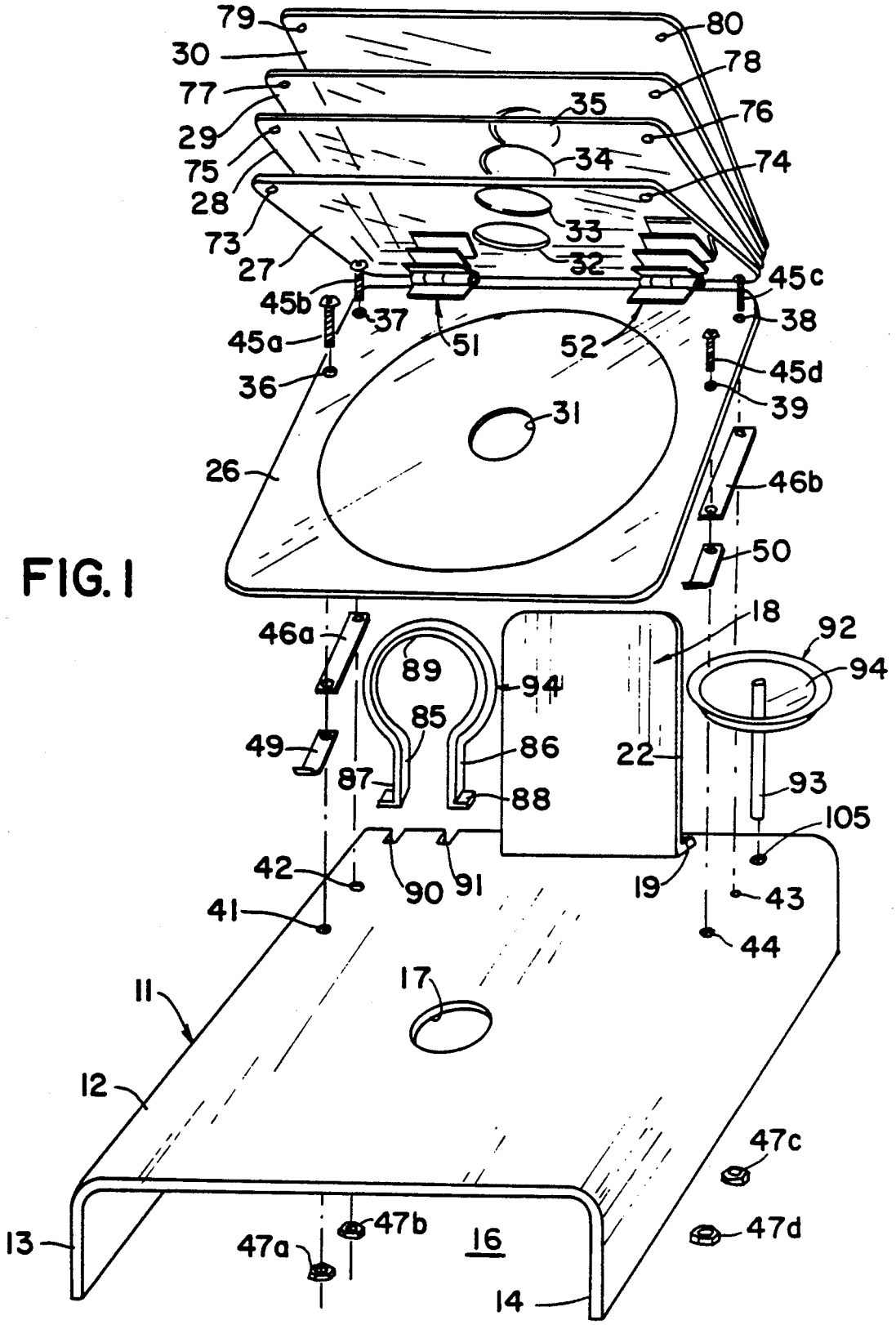
FIG. 1 is an exploded perspective view of one embodiment of the apparatus for making pouch or pocket type packaging in accordance with the present invention.

Referring to the drawings, FIGS. 1 to 12 show one form of apparatus generally designated 10 for fabricating and assembling pouch or pocket type packages in accordance with the present invention.

Those skilled in the art will recognize from the description of the apparatus and method for making and fabricating floral displays, mini-gifts and pouch or pocket type packages, that the difference between the pouch or pocket type packages and for example the floral displays is that the central depression or pocket that is formed as hereinafter more fully described will in the case of a floral display or like type of party favor, not be filled with any random items such as candies, play jewelry or trinkets. However, in order to show the versatility of the apparatus and method in accordance with the present invention, the apparatus for fabricating more complex pouch or pocket type package was selected to illustrate the method in accordance with the present invention. It will be understood however that it is not intended to so limit the present invention to the fabrication of such packaging but that the apparatus and method can be widely used for a variety of floral displays and mini-gifts as well as for making such pouch or pocket type packages.

Thus, referring further to FIGS. 1 to 12 of the drawings, apparatus 10 is shown as including a generally inverted U-shaped base 11 fabricated, formed, cast or injection molded preferably from plastic materials such as acrylic, polypropylene, ABS and the like. Base 11 has a top 12 and oppositely disposed and spaced side supports 13 and 14 which hold the top 11 a predetermined spaced distance above any suitable supporting surface generally designated 15, so that a recovery space 16 is formed within the area defined by the underside of the top 12, the supporting surface 15, and the spaced side supports 13 and 14. Space 16 is open at the front and back ends of base 11 and will be sufficiently large to enable the packaged formed on the apparatus to be conveniently removed through the front or back opening of the space 16 without disturbing the apparatus and without damaging the newly formed package as is more fully described hereinafter with respect to the operation of the apparatus and method for forming a package in accordance with the present invention, floral displays and other unique mini-gifts.

Top 12 is provided with a sized and shaped opening 17 which extends through the top 12 so that it communicates freely with recovery space 16. The sized and shaped opening determines the diameter of the pouch or pocket of the package formed on apparatus 10. While the opening 17 is shown in circular form, those skilled in the art will readily recognize that the opening could be oval, square, or irregularly shaped, depending on the particular needs of the package being formed on the apparatus, without departing from the scope of the present invention, all of which is shown by FIGS. 1, 2, 3, 4, 5, 6, 7, 8, and 9 of the drawings.

FIGS. 1, 2, 3, 4, 5, 6, 7, 8, and 9 also show that a plate support 18 is connected to the top 12 medially between the side members 13 and 14 and adjacent to the back end of the base 11. Plate support 18 is L-shaped in side elevation so that the short leg 19 of the plate support 18 can be connected to the top 12 of the base 11 by any suitable means such as spaced bolts and nuts as at 20 and 21 to position the long leg 22 of the plate support 18 in a generally vertical position normal to the upper side or upper surface of the top 12, for reasons that will become clear from the operation of the apparatus 10 as hereinafter described.

While the plate support 18 is shown as connected to the top 12 of the base 11 by means of bolts and nuts 20 and 21, those skilled in the art will readily recognize that the short leg 19 can be adhesively connected or welded into assembled position without departing from the scope of the present invention and without changing the use thereof in the course of the operation of apparatus 10.

A plate assembly 25 consisting of a plurality of fixed and pivotably connected and operatively associated plates as at 26, 27, 28, 29, and 30 is so disposed that the plate assembly 25 can be fixedly connected to the top 12 by one of the plates 26 as is also shown in FIGS. 1, 2, 3, 4, 5, 7, 8, and 9 of the drawings.

Figure 6:
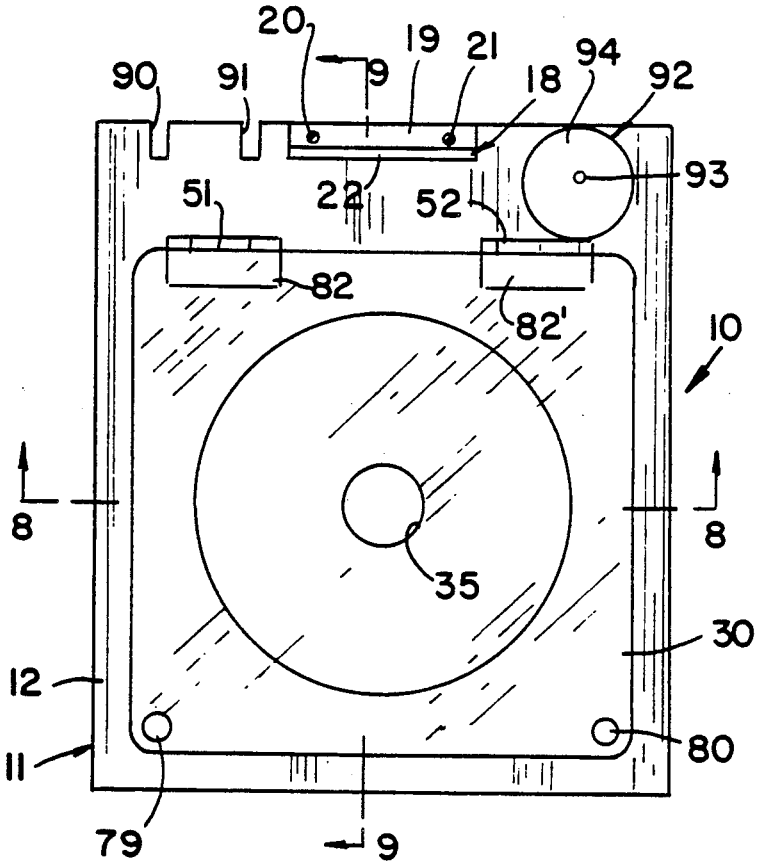
FIG. 6 is a top plan view of the apparatus shown in FIGS. 1, 2, 3, 4, and 5 with the plate assembly in the closed or engaged position.
Figure 7:
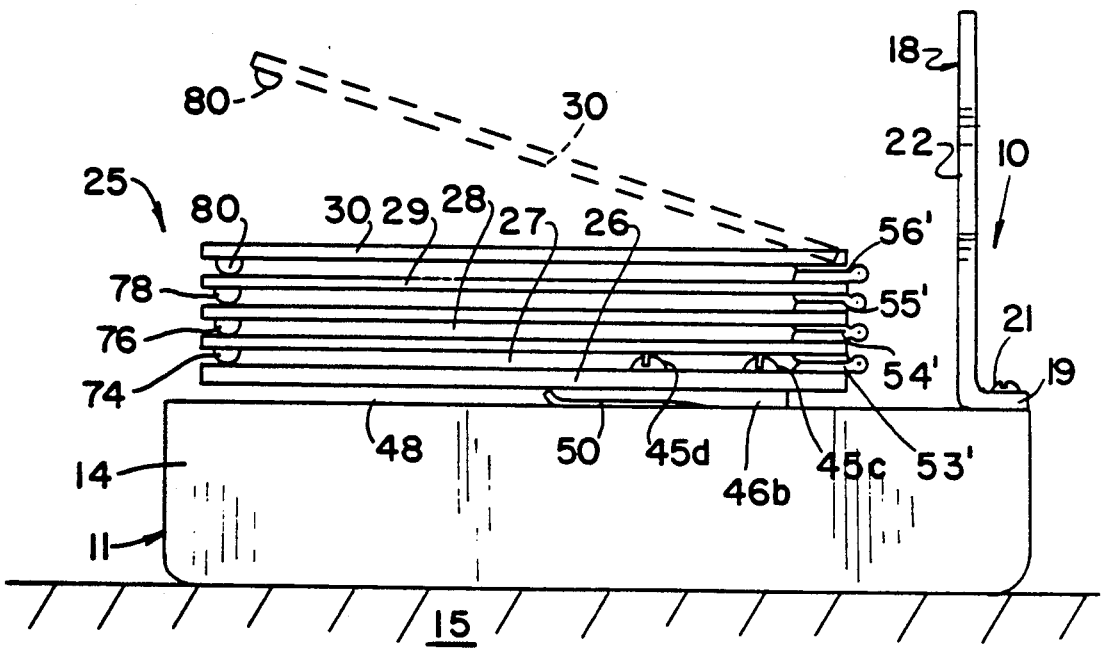
FIG. 7 is a side view of the apparatus shown in FIGS. 1, 2, 3, 4, 5, and 6 with the plate assembly in the closed or engaged position in solid lines and one of the movable plates moving to the open or non-engaged position in phantomized dotted lines.
Figure 8:
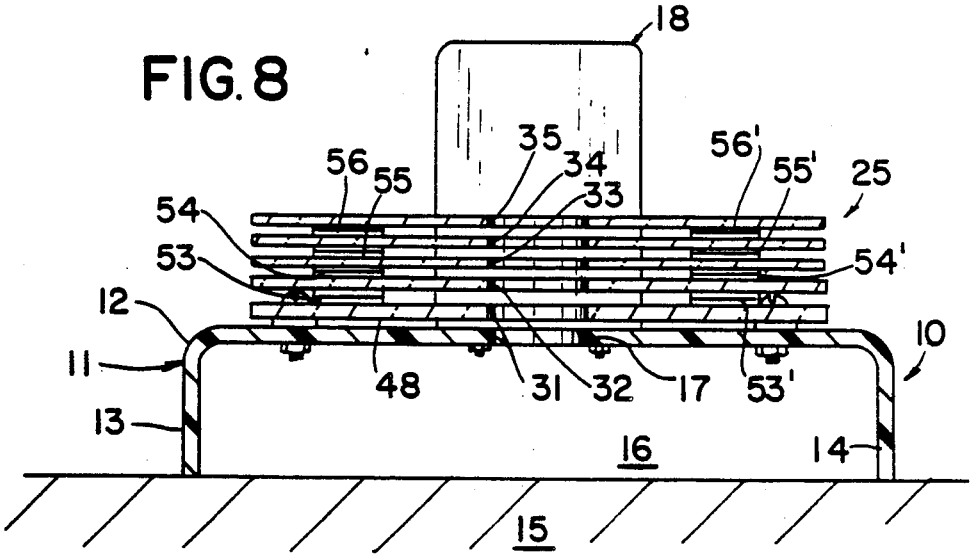
FIG. 8 is a vertical cross-section taken on line 8—8 of FIG. 6.
Figure 9:
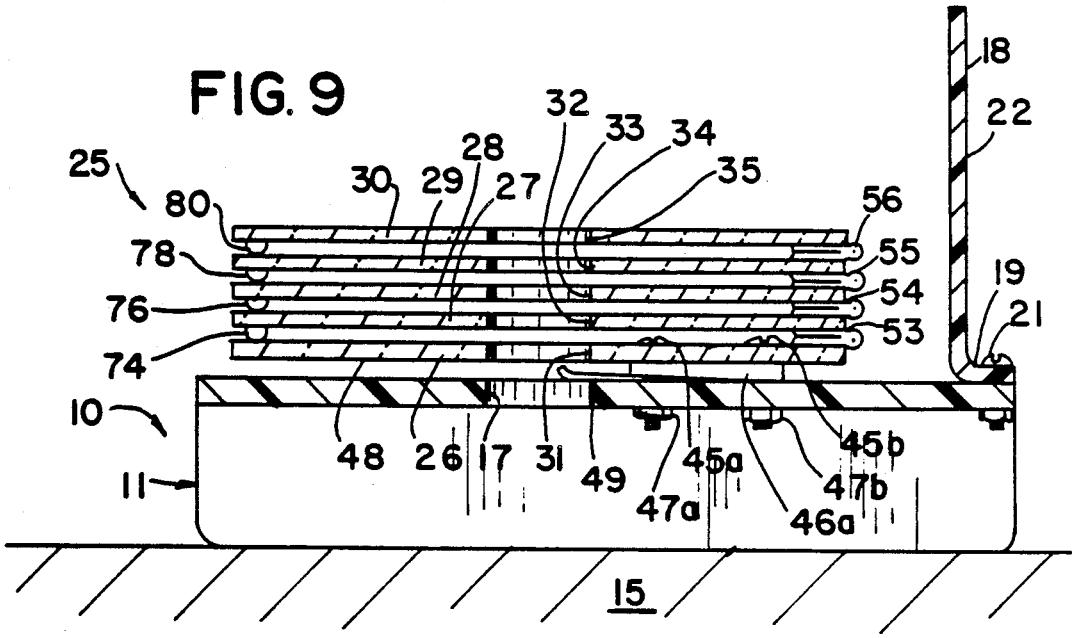
FIG. 9 is a vertical cross-section taken on line 9—9 of FIG. 6.
Figure 10:
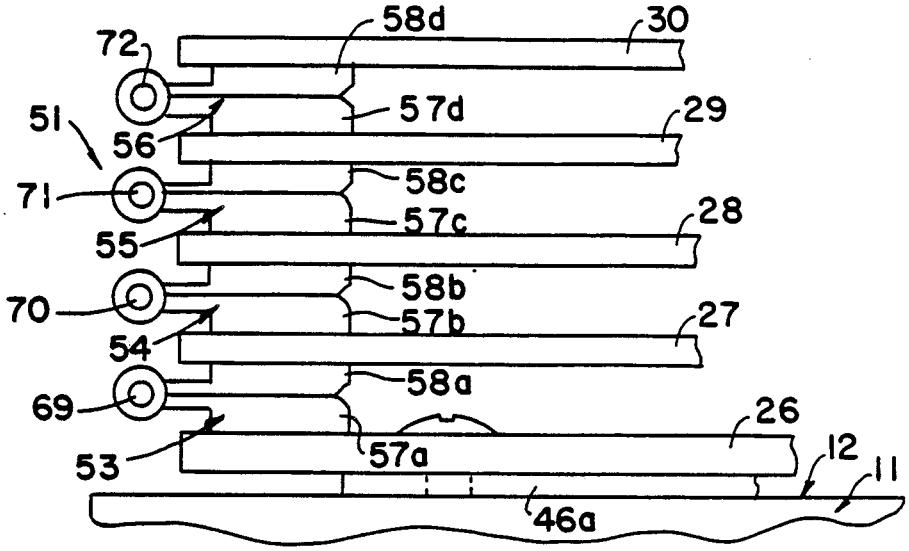
FIG. 10 is an enlarged fragmentary view of one hinge section for the plate assembly on the apparatus shown in FIGS. 1 to 9 of the drawings showing the connection of the hinge to the fixed plate and the respective movable plates of the plate assembly.

Plates 26, 27, 28, 29, and 30 are shown as square in the top plan view at FIG. 6 and will also be made of any suitable type plastic material such as acrylic or polypropylene. Each of the respective plates 26, 27, 28, 29, and 30 are provided respectively with an opening as at 31, 32, 33, 34, and 35 which have the same diameter and shape and are so positioned in the respective plates 26, 27, 28, 29, and 30 that after the plate assembly 25 is connected to top 12 of the base 11 as hereinafter described, then during operation of the apparatus 10, the openings 31, 32, 33, 34, and 35 will be pivoted into alignment with each other and with the sized and shaped opening 17 to enable pouch or pocket type packages to be fabricated in accordance with the method of the present invention, all of which is shown in FIGS. 1, 2, 3, 6, 8, and 9 of the drawings.

In side view as shown in FIGS. 2, 3, 4, 5, 7, 8, and 9 plate 26 of plate assembly 25 will be thicker than the associated plates 27, 28, 29, and 30 because plate 26 is used to securely connect the plate assembly 25 to top 12 of base 11.

Thus, plate 26 and top 12 have spaced and aligned openings therein as at 36, 37, 38, and 39 on plate 26 and 41, 42, 43, and 44 on the top 12 to permit headed bolts **45*a*, 45*b*, 45*c* and 45*d* to be inserted through the aligned openings. Spacers 46*a* and 46*b* will be placed between the upper surface of top 12 and the underside of plate 26 to hold plate 26 in predetermined space relation from the upper surface of the top 12 so that when nuts 47*a*, 47*b*, 47*c* and 47*d* are connected to the headed bolts 45*a*, 45*b*, 45*c*, and 45*d*, the entire plate assembly will be held in tight and fixed engagement to the base 11 such that the portion of plate 26 adjacent to the front end of base 11 will have a free space 48, shown clearly in FIGS. 7, 8 and 9, between the upper surface of top 12 and the under side of plate 26 extending rearwardly from the front of the base 11 to a point beyond the sized and shaped opening 17 in top 12 of base 11**.

Also connected in position by the bolts **45*a*, 45*b*, 45*c*, and 45*d*, spacers 46*a* and 46*b* and nuts 47*a*, 47*b*, 47*c*, and 47*d* are a pair of spaced clips 49 and 50 which are on opposite sides of the sized and shaped opening 15 in top 12. The spaced clips 49 and 50 extend into the free space 48 and coact therewith to hold fastening strips, ribbons and the like which are stretched from side to side across the upper surface of top 12 and are passed through the free space 48 for engagement with the clips 49 and 50** until they are needed during the formation of the pouch or pocket type packaging, the floral display, or mini-gift in accordance with the method of the present invention.

Figure 2:
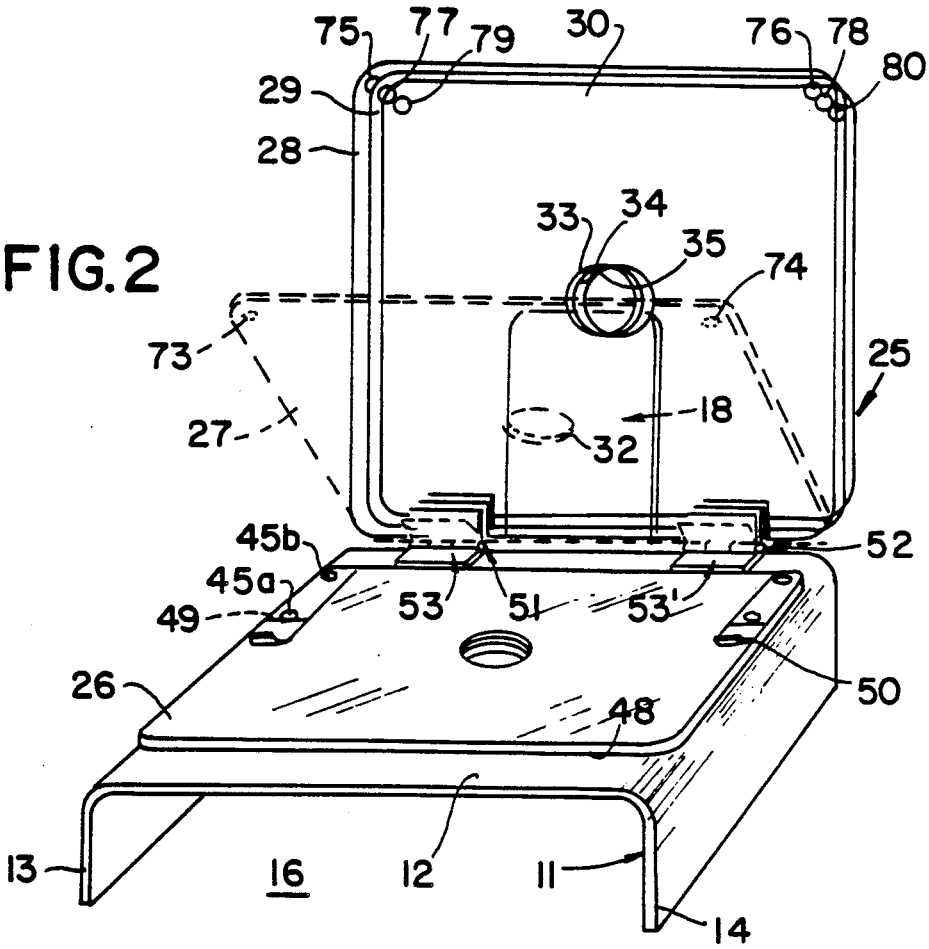
FIG. 2 is a perspective view of the apparatus shown in FIG. 1 with the movable plates of the plate assembly shown in the open or disengaged position in solid lines and one of the movable plates moving to the closed or engaged position shown in the phantomized dotted lines.
Figure 3:
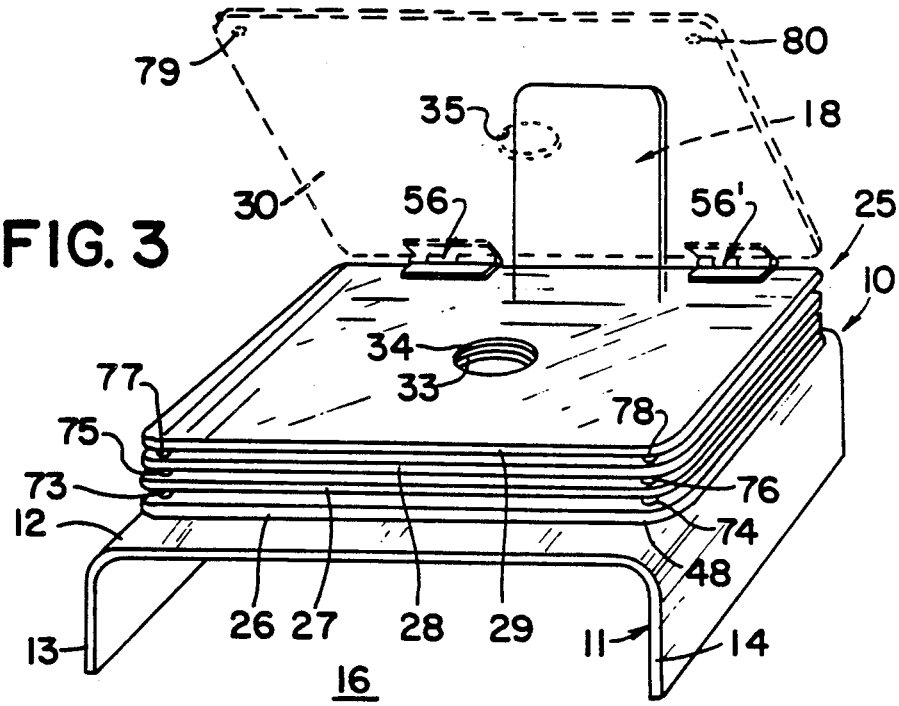
FIG. 3 is a perspective view of the apparatus shown in FIGS. 1 and 2 with the plate assembly shown in the closed or engaged position in solid lines and one of the movable plates of the plate assembly moving to the open or disengaged position shown in the phantomized dotted lines.
Figure 4:
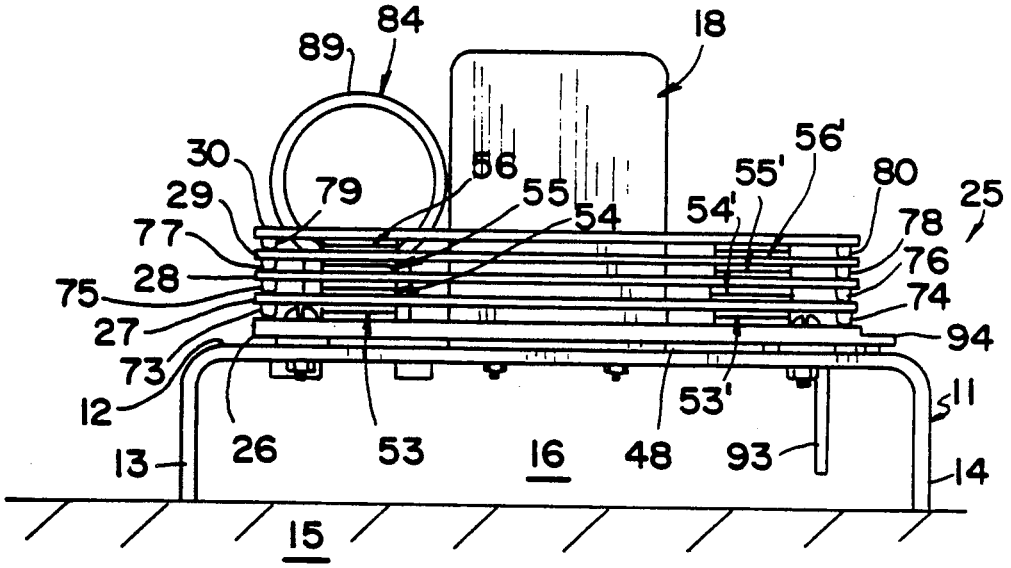
FIG. 4 is a front view of the apparatus shown in FIGS. 1, 2, and 3 with the plate assembly in the closed or engaged position.

Referring further to FIGS. 1 to 9 of the drawings, the remaining plates 27, 28, 29, and 30 are pivotally connected at their respective back ends to the back end of the heavier fixed plate 26 by special hinges 51 and 52 which permits each of the respective plates 27, 28, 29, and 30 to be pivoted from an open or disengaged position when the plates 27, 28, 29, and 30 rest against the plate support 18 or against each other as shown in FIG. 2 by the solid and phantomized lines which illustrate the plates being moved from these respective open or disengaged positions to the closed or engaged position as shown in FIG. 3 and vice versa. When pivoted to the closed or engaged position for forming the pouch or pocket type package in accordance with the method of the present invention, the respective movable plates 27, 28, 29 and 30 will overlie either the upper surface of plate 26 or that of an associated one of the said movable plates.

The special hinges 51 and 52 are multi-unit connectors formed so that in the event any of the respective plates 26, 27, 28, 29, and 30 are damaged or if it is necessary to change a plate or plates to provide an improved or different operative association, the plates can be easily removed and replaced. Since hinges 51 and 52 are substantially identical to each other, only hinge 51 has been illustrated in enlarged form at FIGS. 10, 11 and 12 to show the exact construction. However, those skilled in the art will readily recognize that hinge 52 has the same construction and therefore the same numbers have been applied to hinge 52 with a prime thereon to distinguish them from the equivalent parts in hinge 51.

Thus, referring to FIGS. 1, 2, 3, 4, 5, 6, 7, 8, 9, 10, 11 and 12, hinges 51 and 52 are shown as comprising a plurality of hinge sections or pairs 53, 54, 55 and 56 for each of the respective movable plates 27, 28, 29 and 30.

Each of the hinge sections 53, 54, 55 and 56 have coacting right sided hinge pieces as at **57*a*, 57*b*, 57*c* and 57*d* and left sided hinge pieces as at 58*a*, 58*b*, 58*c* and 58*d*. The respective right sided hinge pieces and left sided hinge pieces are generally rectangular in plain view and can be affixed to the associated fixed plate 26 and movable plates 27, 28, 29 and 30 by any suitable means such as an epoxy adhesive or by being molded integrally with the respective fixed and movable plates all of which is clearly shown in FIGS. 1, 2, 3, 4, 5, 7, 8 and 9 and more particularly in the detail of FIGS. 10, 11 and 12**.

Figure 11:
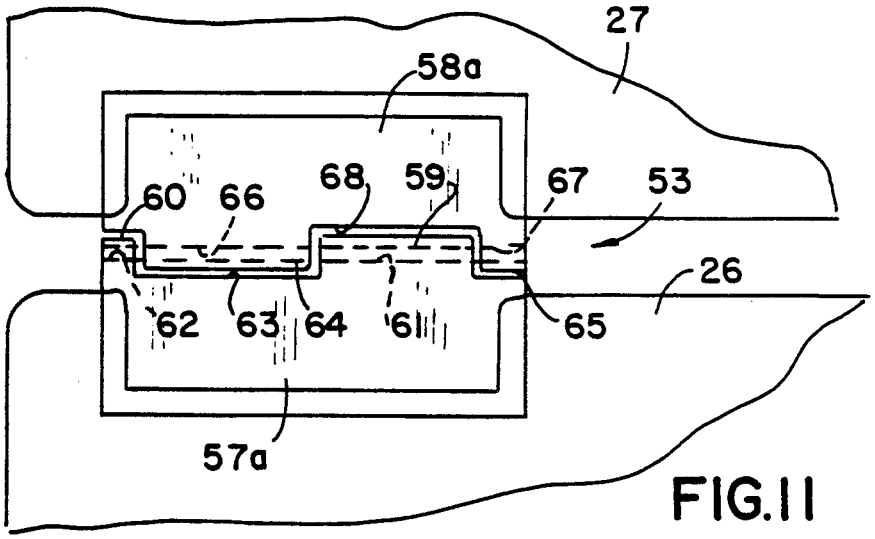
FIG. 11, is an enlarged view of the hinge pieces on a hinge section for the hinge shown in FIG. 10.
Figure 12:
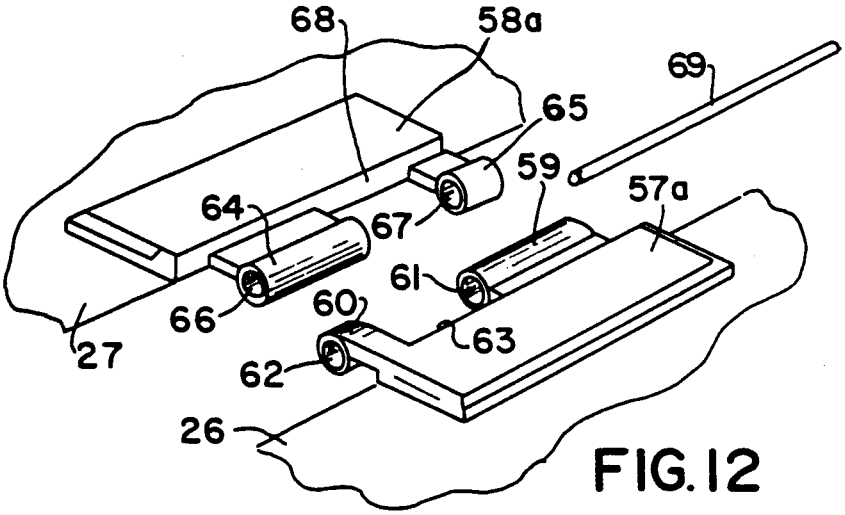
FIG. 12 is an exploded perceptive view of the hinge pieces on the hinge section shown in FIG. 11.

FIGS. 11 and 12 also show that the right sided hinge pieces **57*a* to 57*d* have spaced rearwardly projecting hinge bosses as at 59 and 60 which have respectively transverse bores 61 and 62 extending end to end therethrough in alignment with each other. The spaced hinge bosses 59 and 60 are so sized that they form a predetermined sized space 63 there between. Similarly, the left sided hinge pieces 58*a* to 58*d* have spaced rearwardly projecting hinge bosses as at 64 and 65 which have respectively transverse bores 66 and 67 extending end to end therethrough in alignment with each other. The spaced hinge bosses 64 and 65 are also sized so that they form a predetermined sized space 68 there between. FIG. 11 shows that the spaces 63 and 68 and the respective right sided hinge pieces and left sided hinge pieces are so sized that each associated pair of said right sided hinge pieces and left sided hinge pieces can be interfitted with each other to bring their transverse bores 61, 62, 66 and 67 in alignment with each other. Hinge pins as at 69, 70, 71 and 72 can be removably inserted into sliding fit engagement with each respective pair of coacting right sided hinge pieces and left sided hinge pieces 57*a* and 58*a* on hinge sections 53; 57*b* and 58*b* on hinge section 54; 57*c* and 58*c* on hinge section 55, and 57*d* and 58*d* on hinge section 56**.

The hinge pieces for the respective coacting hinge sections or pairs 53, 54, 55 and 56 are connected to the back end of their associated fixed and movable plates 26, 27, 28, 29 and 30 of the plate assembly. Each of the plates 27, 28, 29 and 30 can be manually pivoted back and forth between the position as shown in FIG. 2 from an upright, open or disengaged position where they are resting against the plate support 18 to a closed or engaged position as shown in FIG. 3 where they overlie the fixed plate 26 and top 12 of the base 11 so that all the respective openings 31, 32, 33, 34 and 35 in the top 12, and the fixed and movable plates 26, 27, 28, 29 and 30 of the plate assembly are in alignment with each other.

Since the hinge pins 69, 70, 71 and 72 are removably inserted into the respective aligned transverse bores 61, 62, 66 and 67 of the respective hinge sections or pairs 53, 54, 55 and 56, they not only serve to permit the movable plate of the plate assembly 25 to be pivotably connected in assembled position, but on removal of a hinge pin or pins, enable a movable plate to be removed or replaced as may be necessary due to damage of a plate or for modifying the size or nature of the unique package, mini-gift or floral arrangement being formed.

Those skilled in the art will readily recognize that while four movable plates 27, 28, 29, and 30 have been illustrated in the embodiment of the apparatus shown in FIGS. 1 to 15 for making pouch or pocket packages, floral arrangements or other unique devices in accordance with the present invention that the hinges 51 and 52 can be easily modified either to reduce or increase the number of movable plates as may be needed for forming a particular size or type of pouch or pocket type package, floral arrangement or other unique mini-gifts in accordance with the method of the present invention.

Further referring to FIGS. 1, 2, 3, 4, 5, 6, 7, 8, and 9 the movable plates 27, 28, 29, and 30 will by reason of the finite thickness of the respective right sided hinge pieces 57*a, b, c* and *d* and left sided hinge pieces 58*a, b, c* and *d* will maintain a corresponding predetermined finite clearance between all of the adjacent surfaces of each of the fixed plate 25 and movable plates 27, 28, 29 and 30 to prevent binding of the materials from which the pouch or pocket type package, floral design and other unique mini-gifts are fabricated in accordance with the methods of the present invention.

In order to maintain such clearance and preferably to place the fixed plate 25 and movable plates 27, 28, 29, and 30 into generally parallel planes, both for improved operation and for cosmetic purposes each of the fixed and movable plates are provided on their respective lower sides or under surfaces at their respective front ends with spaced resilient spacers as at 73 and 74 for the movable plate 27; 75 and 76 for the movable plate 28, 77 and 78 for the movable plate 29, and 79 and 80 for the movable plate 30. These resilient spacers 73 to 80 inclusive act to hold the respective fixed plates and movable plates in the desired predetermined spaced relation, all of which is clearly shown in FIGS. 1, 2, 3, 4, 5, 6, 7, and 9, of the drawings.

Figure 13:
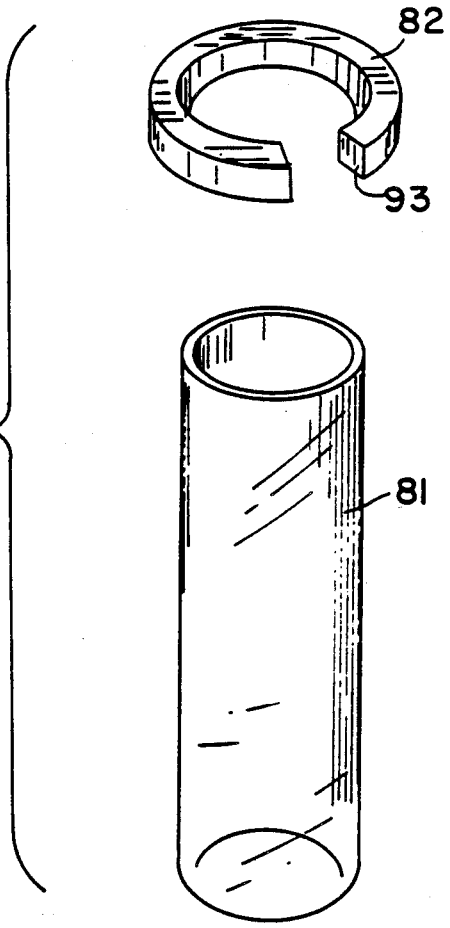
FIG. 13 is an exploded perspective view of the pusher member and the associated sizing ring.
Figure 14:
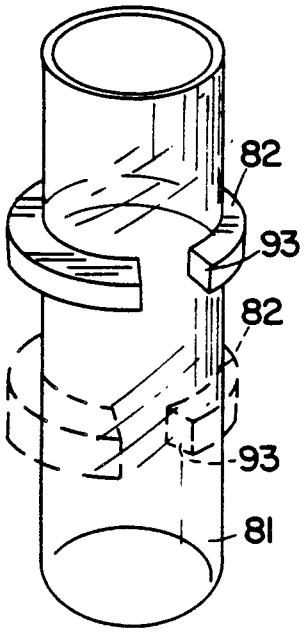
FIG. 14 is a perspective view of the pusher member with the sizing ring operatively and slidably mounted thereon showing a first position for the sizing ring in solid lines and a second position in phantomized dotted lines.

In order to form and to fix the size or depth of the central depression for the floral design or the pouch or pocket in the package formed in accordance with the present invention, a plunger or pusher 81 and an associated sizing ring 82 slidably disposed on the pusher 81 as shown in FIGS. 13 and 14 of the drawings, are used as hereinafter described.

Plunger 81 is an elongated cylindrical member made of plastic material such as acrylic or polypropylene and preferably will be in tubular form as illustrated at FIGS. 13 and 14 for light weight and to provide a conduit for filling the pouch or pocket formed in the package or mini-gift.

The associated sizing ring 82 is a generally annular member and is made from the same type of plastic material as pusher 81. Sizing ring 82 has a diameter slightly less than the outer diameter of the pusher 81. The sizing ring 82 however is split or has an arcuate section cut thereon as at 83 to provide the sizing ring 82 with sufficient resilience so that it can be connected for slidable movement along the elongated cylindrical pusher 81.

When the pouch or pocket type package, floral design or other unique mini-gifts are being formed and the movable plates 27, 28, 29, and 30 are pivoted to the closed or engaged position with the materials from which the pouch or pocket type package, floral design or other unique mini-gifts are formed in position, one end of the pusher tube 81 can be inserted into the uppermost opening 35 in the movable plate 30 and then progressively pressed through the openings 34, 33, 32, 31 and finally 17 in the top 12 of base 11 until the sizing ring 82 is brought into engagement with the upper surface of the top movable plate 30 fixing the depth of the pocket in the material, all of which is more fully described below with reference to FIGS. 23A to G of the drawings.

The apparatus in accordance with the present invention is also provided with accessory devices. The first is a clamp and handle 84 which is a generally inverted U-shaped member also made of plastic material having some degree of resiliency so that the respective legs 85 and 86 normally disposed to spring away from each other can be squeezed together when it is used. In this regard it will be noted that the respective legs 85 and 86 have adjacent the ends thereof lateral projections 87 and 88 and these serve to lock the clamp and holder in assembled position during use thereof.

In the use of the clamp and holder 84 the movable plates 27, 28, 29, and 30 are pivoted to the closed or engaged position and the legs 85 and 86 of the U-shaped clamp and holder 84 are squeezed together until the legs 85 and 86 can be passed through the aligned openings 35, 34, 33, 32, 31, and 17 in the movable and fixed plates of the plate assembly 25 and the base 11, at which time the legs of the clamp and holder member are allowed to expand so that the lateral projection 87 and 88 can engage with the underside of the top 12 about the opening 17 therein. In this position the clamp and handle 84 will act to lock the movable plates in the engaged position and the handle portion 89 can be used to lift or carry the apparatus 10 so there will be no danger that the movable plates 27, 28, 29, and 30 of the plate assembly will be damaged. The base 11 is provided with a pair of spaced grooves as at 90 and 91 in which the clamp and the handle member 94 can be placed when it is not in use, all of which is shown in FIGS. 1, 4, 5, 6, 15 and 16 of the drawings.

Figure 5:
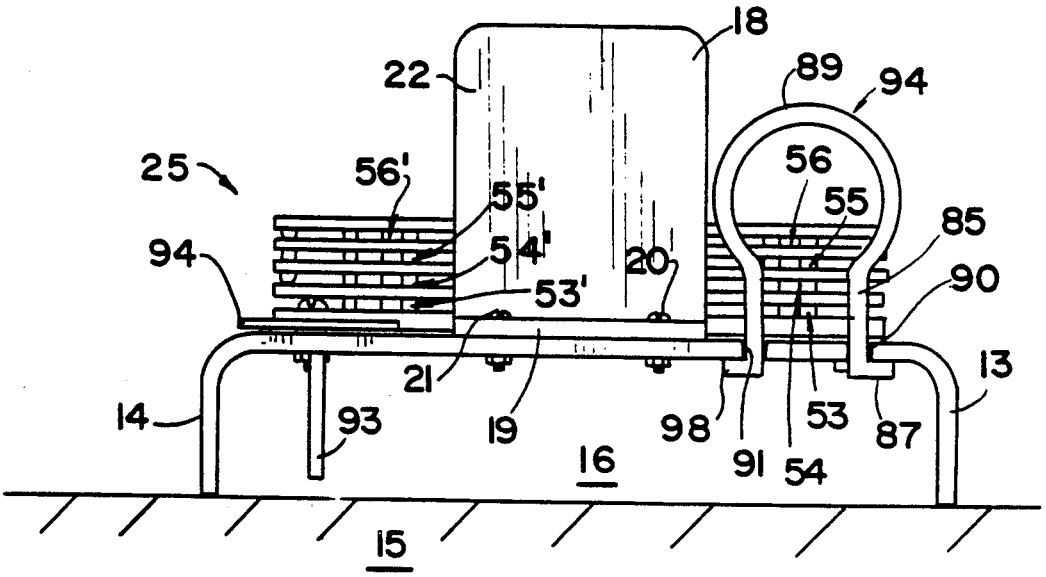
FIG. 5 is a back view of the apparatus shown in FIGS. 1, 2, 3, and 4 with the plate assembly in the closed or engaged position.

A second accessory device is an umbrella member 92 which consists of a thin shaft 93 having a flat generally circular flange 94 at one end thereof. This device is used for aiding in the fabricating of a decorative gift or floral display in the same manner used for forming the pouch or pocket type packaging but which differs to the extent that the pouch or pocket is merely simulated in order to establish the decorative type flower display or other decorative mini-gift which therefore can also be made on the apparatus 10. The umbrella member 92 can be conveniently stored in the opening 95 adjacent the back end of the base 11, all of which is shown in FIGS. 1, 5, and 6 of the drawings.

The method for making floral displays, decorative or other devices will be the same as the method for making the pouch or pocket type packages as will be hereinafter more fully described except that the pouch or pocket which is formed will not be filled with random items. In order to form the decorative flower spray, mini-gift or other multi-layered device, the thin stem 93 of the umbrella 92 will be inserted into the pocket as formed and the layers of material pulled together around the stem 93 until they are firmly tied, thereafter the stem is removed to provide the floral display or other unique decorative device or mini-gift.

Figure 17:
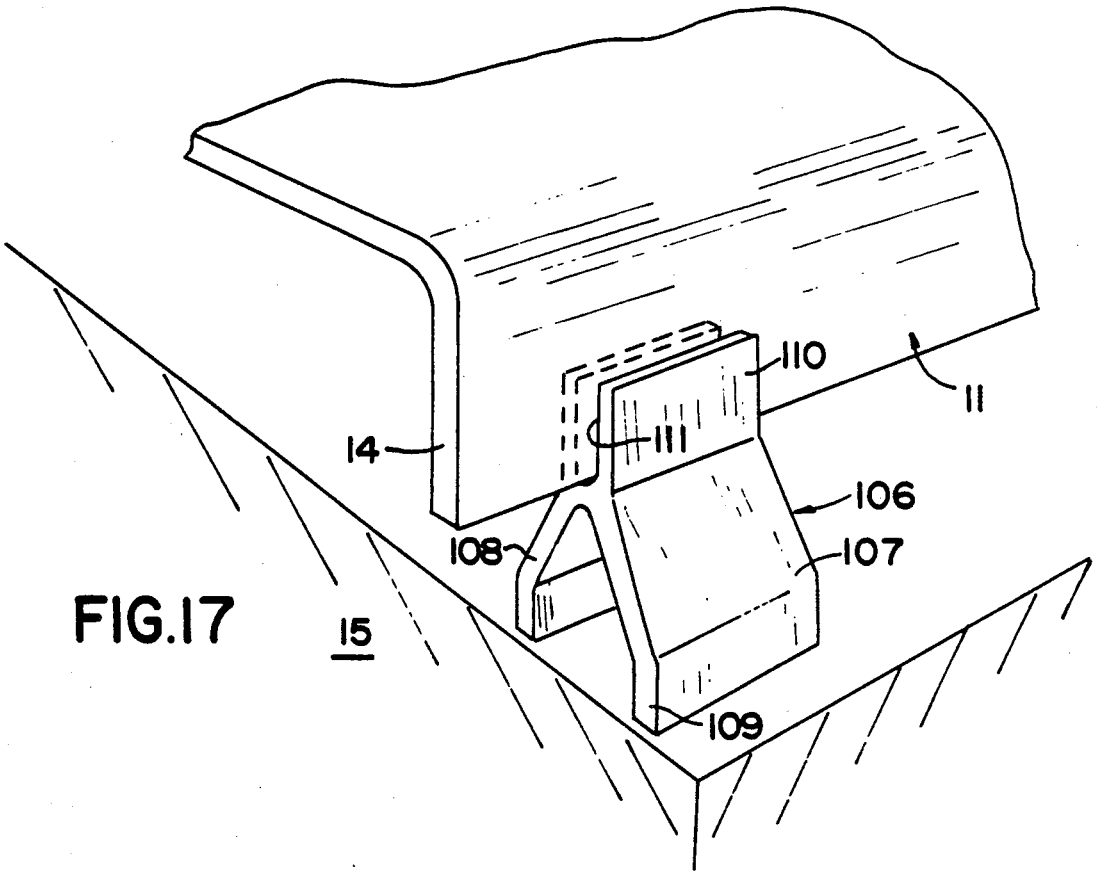
FIG. 17 is a partial perspective view of a bracket for raising and holding the apparatus above a supporting surface to increase the space below the base, a fragment of which is shown.
Figure 18:
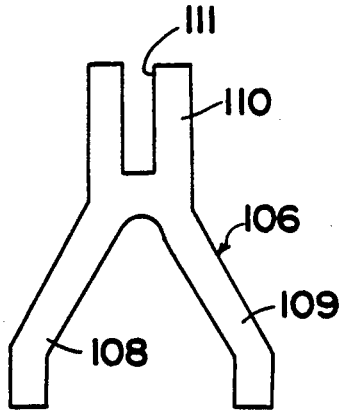
FIG. 18 is an end view of the bracket shown in FIG. 17.
Figure 19:
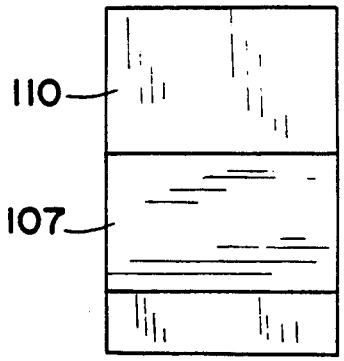
FIG. 19 is a side view of the bracket shown in FIG. 17.

FIGS. 17, 18, and 19 of the drawings show a third accessory device for raising the apparatus an additional distance above the supporting surface 15. This is done by a plurality of brackets 106 which are shaped to engage the sidewalls 13 and 14 and are disposed in spaced relation to provide proper stability.

One bracket 106 illustrated in FIGS. 17, 18, and 19 has an inverted Y-support 107 which rests on the supporting surface the legs 108 and 109 being spaced to increase the base for the bracket 106. Connected to the upper end of the Y-support 107 is an upper member 110 grooved as at 111. The groove 111 is sized for a force fit so the respective side supports 13 and 14 will be engaged and held by the brackets 106.

ALTERNATE EMBODIMENT

A fourth accessory device provides an alternate embodiment of the apparatus in accordance with the present invention as is shown in FIGS. 20, 20A, 20B, 21 and 22. In this alternate embodiment the accessory device is in the form of a plurality of adapters such as the adapters 120, 124 and 220 illustrated in FIGS. 20, 20A, 20B, 21 and 22 of the drawings. These adapters permit the size of the opening in the top of the base for the apparatus to be changed to one of a greater or lesser diameter as may be desired or necessary in accordance with the method for forming pouch or pocket type packages, floral displays and other unique devices on the apparatus in accordance with the present invention.

Thus referring to FIG. 20, the base 111 is shown having a top 112 and side supports 113 and 114 to hold the top a predetermined distance from a suitable supporting surface as at 115 whereby a recovery space is formed by the top 112 the side supports 113 and 114 and the supporting surface 115 which construction is the same as that above described with the form of the invention shown in FIGS. 1 to 9 of the drawing.

The top 112 of base 111 however, differs from that of the top and base of the form of the invention shown in FIGS. 1–9 in that the top 112 has a large diameter opening 116 form therein which has a circumferential groove 117 adjacent to the upper surface of the top 112. While the opening 116 and the circumferential groove 117 are shown in circular form, those skilled in the art would readily recognize that the opening and groove may be square or any other shape as may be required for the operation and method of this alternate embodiment of the present invention.

On opposite sides of the annular groove 117, in the opening 116, cutouts as in **118*a* and 118*b* which communicate with undercut 119*a* and 119*b* are provided for locking any one of the adapter 120 into assembled position in the opening 116**.

The plurality of adapters as shown by the illustrated adapter 120 are generally flat plate like members made of the same type of plastic material referred to herein for the base and the fixed and movable plates of the plate assembly 25 of the form of the invention above described. Adapter 120 will have a mating shape in this case circular and the periphery will be flanged as at 121 with the lateral projections **122*a* and 122*b* so that the adapter 120 will fit and snugly engage the opening 116, the circumferential groove 117 and the cutouts 118*a* and 118*b* so that when the adapter 112 is rotated the lateral projections 122*a* and 122*b* will engage the undercuts 119*a* and 119*b* locking the adapter into assembled position in the opening 113 of the top 112 for base 111**.

The adapter 120 is provided with an opening as at 123 which extends therethrough so that the opening communicates with the recovery space 116 below the top 112 of base 111.

It is thought clear that the diameter of the opening 123 in the adapter 120 can be easily modified by merely inserting a different adapter with a different sized opening in place of adapter 120 and thus various sized or shaped openings as indicated by the phantomized lines **123*a* and 123*b*** can be obtained in accordance with this embodiment of the invention.

Those skilled in the art will readily recognize that in order for the apparatus 110 in accordance with this embodiment of the invention to work properly that the associated plate assembly, not shown, will be substantially identical in form to that above described for the form of the invention shown in FIGS. 1 to 9 of the drawing except that the openings in the fixed and movable plates thereon also will be sized to correspond with the sized opening in the adapter plate 120. This can be accomplished by either using a corresponding plurality of plate assemblies and having fixed and movable plates which have openings corresponding equal to the sized and shaped opening of the adapter used to modify the diameter of the opening in the top 112 of base 111. Alternatively, the respective fixed and movable plates of the plate assembly can themselves also have adapters, as schematically illustrated by the adapter 124 shown in FIG. 20 to vary the size of the openings in the respective fixed and movable plates to accomplish the desired change in the diameter of the opening for proper operation of the apparatus 110 in accordance with the method of the present invention.

FIG. 20B shows a further form of the adapter 220 which has an Iris assembly as at 221 about the center section for varying the size of the opening 222 in the adapter 220. An actuating lever 223 is used to move the Iris assembly 221 to establish the desired form of the opening. Similar types of adapters can be added to the fixed and movable plates of the matching plate assembly so that a corresponding sized opening in the fixed and movable plates can be established for the apparatus 110. Those skilled in the art will readily recognize that this form of the invention will reduce the number of adapter plates and plate assemblies required for a given apparatus 110 in accordance with this alternate embodiment of the invention.

The plate assembly, generally designated 125 as shown in FIG. 20 for this alternate form of the invention, will be connected to the top of the base 111 in the same manner as above described for the form of the invention shown in FIGS. 1 to 9 of the drawings and the apparatus 110 when assembled will operate in the same manner as the first form of the invention as will now be described.

OPERATION AND METHOD IN ACCORDANCE WITH THE PRESENT INVENTION

Figure 23A:
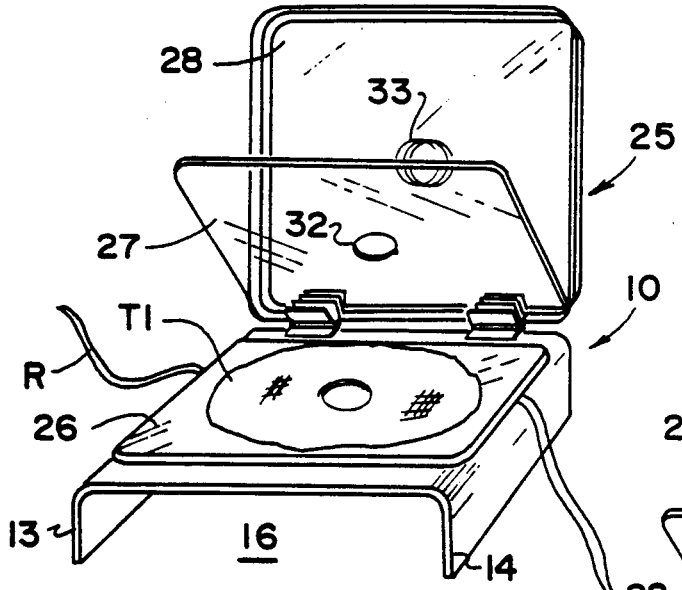
FIGS. 23, A, B, C, D, E, F, and G are diagrammatic sketches showing how the apparatus is used in accordance with the method of the present invention.
Figure 23B:
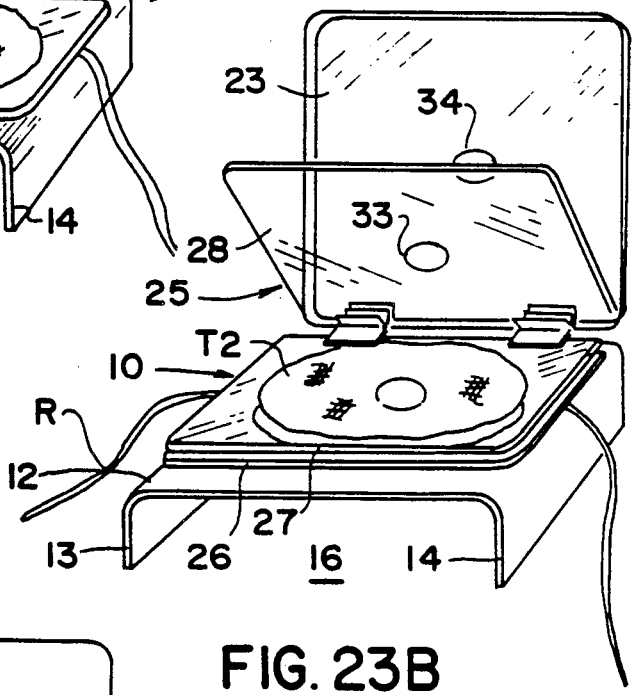
Figure 23C:
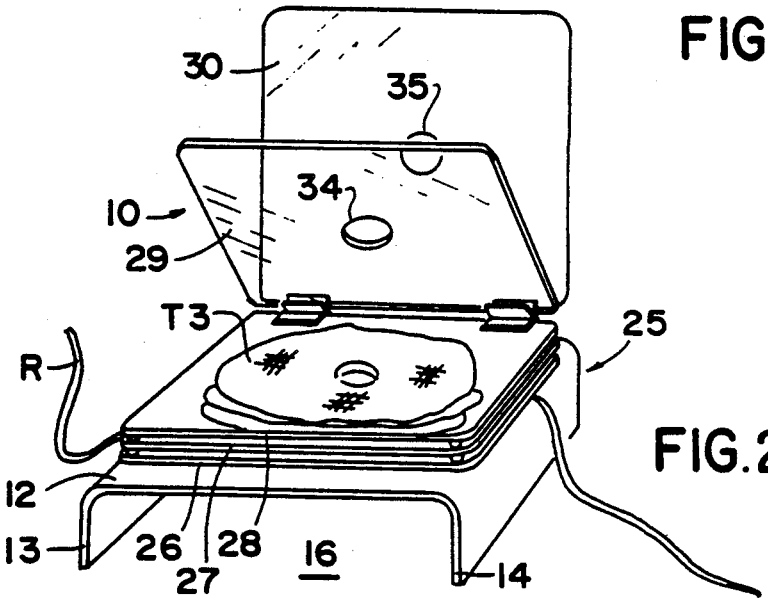
Figure 23D:
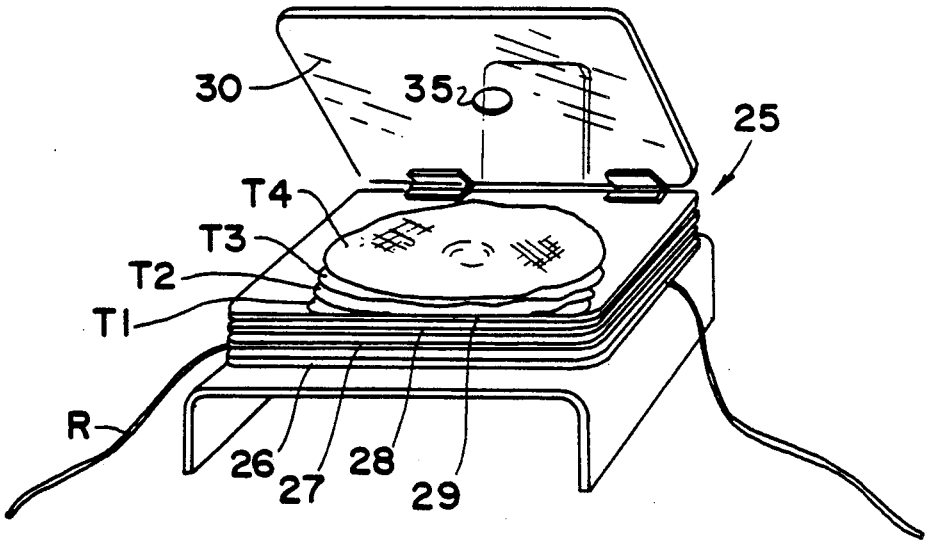
Figure 23E:
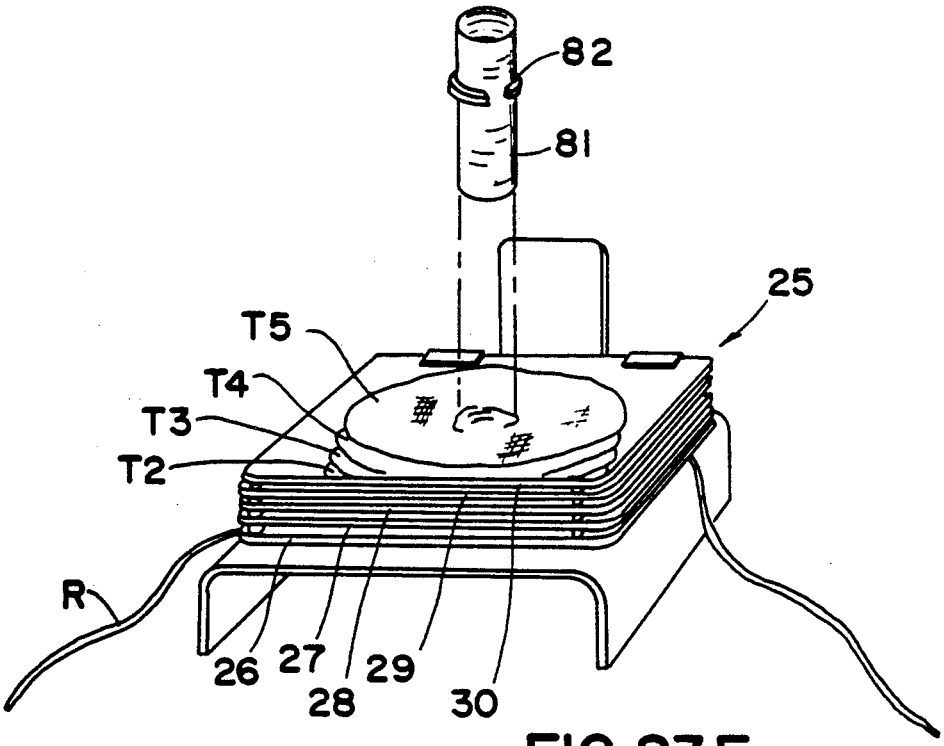
Figure 23F:
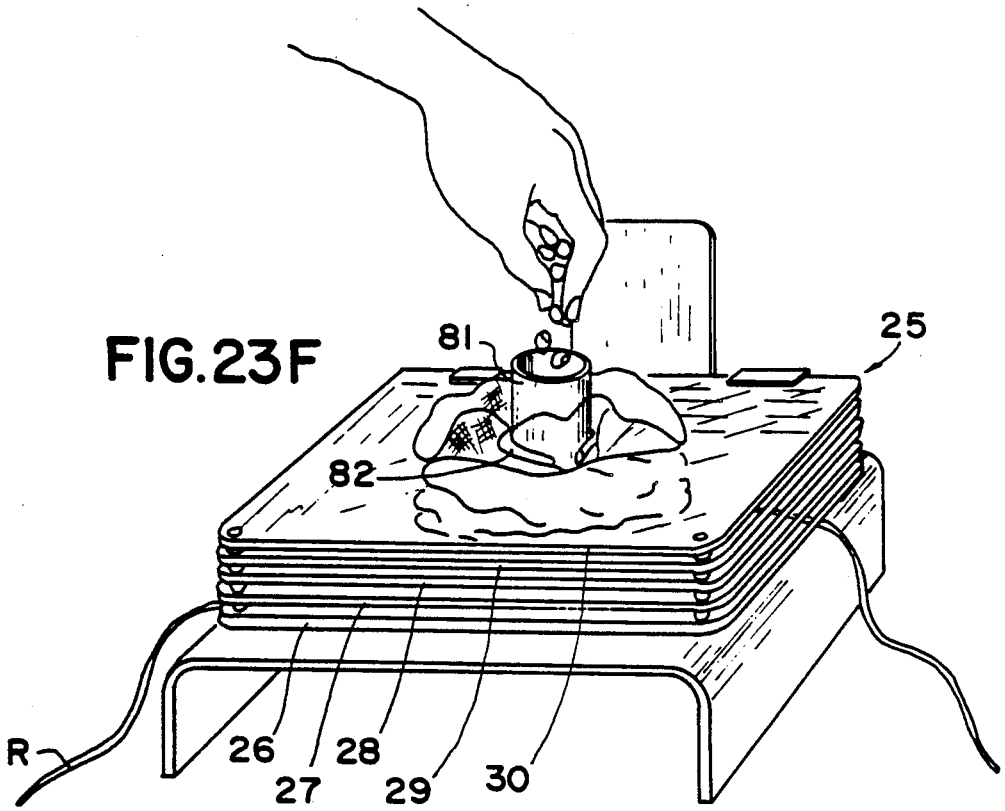
Figure 23G:
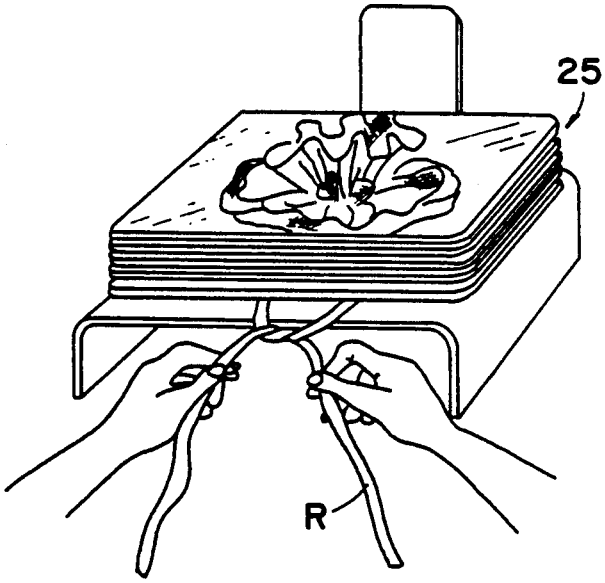
Figure 24:
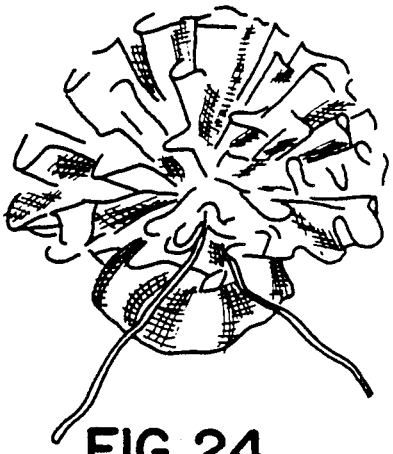
FIG. 24 shows a pouch or pocket type package formed in accordance with the method of the present invention as shown at FIGS. 23A to G.

The operation and method of forming pouch or pocket type packages, floral displays or other unique decorations in accordance with the present invention on the apparatus shown in FIGS. 1 to 12 and above described will be better understood by reference to FIGS. 23A to 23G inclusive of the drawings which show the steps for forming a pouch or pocket type package as is illustrated in FIG. 24 of the drawings.

Thus, all of the movable plastic plates 27, 28, 29 and 30 are first pivoted into the upright position so that they rest against the plate support 18 as shown in FIGS. 2 and 23A of the drawings.

Next, approximately 30 inches of relatively thin and narrow, about ¼", ribbon R is slipped into the space 48 between the fixed plate 26 on base 11 so that the medial section thereof is held in engagement with the oppositely disposed clips 49 and 50 thus placing it on the side of the aligned openings 17 in base 11 and 31 in fixed plate 26 remote from the front end of the base 11.

A first piece of filmy material such as a circularly shaped piece of tulle T1 is now placed on the upper surface of the fixed plate 26 and centered over the aligned opening 17 and 31.

Movable plate 27 is then pivoted from the upright position to a point overlying the fixed plate 26 so as to bring the opening 32 in movable plate 27 into alignment with opening 17 and 31, and then a second circularly shaped piece of tulle T2 is placed on the upper surface of the movable plate 27 and also centered over the aligned opening 33 therein.

As may be desired or required for the particular pouch or pocket type package, floral display or unique mini-gift being formed, additional layers of shaped tulle or other materials can be assembled by pivoting movable plate 28 so that it overlies the movable plate 27 with the opening 33 therein in alignment with the opening 17, 31 and 32 and then placing a third piece of shaped tulle T3 on the upper surface of the movable plate 28. This process being repeated as may be required for movable plates 29 and 30 for the shaped tulle material T4 and T5.

When the desired number of layers of material are assembled between and on the respective fixed plate 26 and movable plates 27, 28, 29 and 30 as is illustrated at FIGS. 23A, 23B, 23C, 23D and 23E, pusher member 81 with the annular sizing device 82 thereon is adjusted to establish the depth of the pocket, as may be desired. Then positioning the pusher element over the uppermost of the aligned openings, the pusher element 81 is pressed down gently to cause the various layers of tulle T1, T2, T3, T4, and T5 to gather, by radial inward movement towards the aligned openings, thus forming the desired pouch or pocket in the layers of material until the sizing ring 82 engages the upper most surface of the plate assembly 25 as is shown in FIGS. 23E and 23F.

With the pusher tube in the full inserted position it is now relatively simple to fill the formed pouch or pocket with any desired random items such as almonds, candies, small toys, cookies, etc., and then the pusher tube 81 can be carefully removed and additional items placed in the vacated opening left by the tube such as a short stemmed silk flower or other device.

When the filling of the pouch or pocket of the packet has been completed and the package is ready to be sealed, the respective right and left hand ends of the ribbon can now be drawn about the portion of the package which extends down through the aligned openings until it is moved to the front of the base 11 where the ribbon can be tied together gathering the layers of tulle together to close the pouch or pocket portion of the package and a second knot will be tied to fully secure the random items in the pouch or pocket of the package, all of which is shown in FIG. 28G of the drawings.

By reaching into the space 16 below the base 11 the now formed package can be gently pulled from the bottom of the machine and removed through the recovery space 16.

The ribbon now can be tied in a bow and if it is of the proper material can be curled in more or less conventional fashion. By fluffing and arranging the various layers of the tulle or other material from which the now formed package has been established, a unique inexpensive and distinctive package is provided in accordance with the apparatus and method of the present invention.

Various design variations can be easily established with the present apparatus and method in accordance with the present invention by, for example, using a filmy material such as tulle in lighter and darker colors to provide a contrasting package, and adding pearl spray or sparkle stick-ons into the center of the package to give a glitter effect. Additionally, strands of differently colored ribbon can be used for a more festive look and any of these unique floral displays, mini-gifts or packages can be used for all types of special or memorable occasions such as birthdays, weddings, Halloween, Thanksgiving, Christmas, housewarming and other parties, and the entire arrangement for the device provides unusual and varied favors for all types of occasions as may be desired providing a mini-gift wrap of exceptional appearance which can be produced and duplicated in reasonable quantities in a short period of time from relatively low cost materials.

While the foregoing description illustrates various preferred embodiments of apparatus and methods in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. Apparatus for forming floral displays, mini-gifts and packages from a plurality of relatively thin layers of material comprising, a. base means having, first surface means, and a first sized and shaped opening extending through said first surface means, b. plate means for operative association with said base means including, a first plate member fixedly connected in predetermined spaced relation to the first surface means on the base means, and at least one other plate member pivotally interconnected with said first plate member to permit movement from an open position to a position overlying and to be held in predetermined spaced relation to said first plate member, c. said first plate member and said at least one other plate member respectively having, second surface means, and second sized and shaped openings therein disposed in assembled position in alignment with said first sized and shaped opening in the base means so that a layer of said relatively thin material can be disposed on each of the respective second surface means to overlie each of the respective second sized and shaped openings, d. means operatively associated with said base means and said plate means insertable into the said respective aligned second sized and shaped openings and first sized and shaped opening to form in each respective layer of relatively thin material sized depressions generally concentric to each other and having an end opening for said sized depressions.

e. said means operatively associated with the base means permits its alternative and selective use as a means forming said depressions in the respective layers of relatively thin material and for forming and filling said depressions depending on which of any one of the said floral displays, mini-gifts and pouch type packages are being formed, and f. connector means to close the end opening of said sized depressions.

2. In the apparatus as claimed in claim 1 wherein the means for pivotally interconnecting said at least one other plate member and for maintaining the at least one other plate member in predetermined spaced relation to the first plate member includes, a. hinge means at one end of said at least one other plate member to pivotally connect said at least one other plate member to the said fixed first plate member, and b. spacer members connected to said at least one other plate member remote from the hinge means for operative coaction with said hinge means to fix said predetermined spaced relation.

3. In the apparatus as claimed in claim 1 wherein said connector means includes, spaced clip means connected to said base means for releasably holding a ribbon and the like connector therebetween for operative association with said layers of relatively thin material.

4. In the apparatus as claimed in claim 1 wherein said connector means includes, a. spaced clip means connected to said base means, and b. said spaced clip means disposed on the first surface means of the base means and between the base means and said first plate member for holding a ribbon and the like connector for operative association with said layers of relatively thin material.

5. In the apparatus as claimed in claim 1 wherein, a. said base means has, connecting means formed in the first sized and shaped opening, and b. adapter means alternatively and selectively connectible in said connecting means to vary the diameter of the first sized and shaped opening.

6. In the apparatus as claimed in claim 1 including;

a. means operatively connected to the first sized and shaped opening for adjusting the diameter thereof, and b. said adjustable means including, circumferentially, disposed elements slidable with respect to each other.

7. Apparatus for forming, floral displays, mini-gifts and packages from a plurality of layers of relatively light material comprising, a. base means having, first surface means, and a first sized and shaped opening extending through said first surface means, b. a plurality of plate members disposed for operative association with said base means, at least one of said plate members fixedly connected in predetermined spaced relation to said base means, said one of said plate members so fixedly connected to said base means having a second surface means and a second sized and shaped opening in said second surface means disposed in alignment with the first sized and shaped opening in said base means to permit at least one layer of said relatively light material to be disposed over the second surface means and to overlie said second sized and shaped opening, c. means for pivotally and serially interconnecting said other plurality of plate members to said one of the plate members fixedly connected to said base means for alternative and selective movement relative to each other from a non-engaged open position to a position overlying each other and the first surface means on said base means, d. said connecting means including, means operative to maintain said plurality of plate members in predetermined spaced relation to each other, e. each of said other plurality of plate members including, third surface means respectively thereon, third sized and shaped openings respectively therein at least equal in diameter to the first sized and shaped opening in said base means and so positioned on the respective plurality of plate members to align with said first sized and shaped opening in the base means when a given one of said other plurality of plate members is pivoted to the overlying position and with the respective second and third openings in each of said plurality of plate members when more than one of said other plurality of plate members are pivoted to the overlying position so that at least a second layer of said relatively light material can be placed on at least one of said respective third surface means of the other plurality of plate members so as to overlie the associated third sized and shaped opening therein, f. means operatively associated with said base means and said plurality of plate members insertable into the said respective aligned third and second sized and shaped openings and first sized and shaped opening to form sized depressions in the respective layers of relatively light material, generally concentric to each other and having an end opening, g. said means operatively associated with the base means permits it alternative and selective use as a means for forming said depressions in the respective layers of relatively thin material and for forming and filling said depressions depending on which of any one of the said floral displays, mini-gifts and pouch type packages are being formed, and h. connector means to close the end opening of said formed depressions to enable the formed floral displays, mini-gifts and packages to be removed from the apparatus.

8. In the apparatus as claimed in claim 7 wherein the means for interconnecting said other plurality of plate members and for maintaining the other plurality of plate members in predetermined spaced relation to the second surface means of the said fixed first plate member and to each other includes, a. hinge means at one end of each of said moveable other plurality of plate members to pivotally connect said moveable other plurality of plate members to the fixed plate member, and b. spacer members connected on each of said moveable other plurality of plate members remote from the hinge means for operative coaction with said hinge means to fix the predetermined spaced relation between each of the respective moveable other plurality of plate members and the fixed plate member and each other in the overlying position.

9. In the apparatus as claimed in claim 7 wherein said connector means includes, spaced clip means connected to said base means for releasably holding a ribbon and the like connector therebetween for operative association with said layers of relatively light material.

10. In the apparatus as claimed in claim 7 wherein said connector means includes, a. spaced clip means connected to said base means, and b. said spaced clip means disposed on the first surface means of the base means and between the base means and said at least one fixed plate means for holding a ribbon and the like connector for operative association with said layers of relatively light material.

11. In the apparatus as claimed in claim 1 or 7 wherein the base means and said plate means are made from plastic material.

12. In the apparatus as claimed in claim 1 or 7 wherein the apparatus is made from a relatively light generally transparent material.

13. In an apparatus as claimed in claim 1 or 7 wherein the apparatus is made from a generally transparent plastic material.

* * * * *